US006014575A

United States Patent [19]

Miura

[11] Patent Number: 6,014,575

[45] Date of Patent: Jan. 11, 2000

[54] SUPERCONDUCTING TRANSMISSION LINE PHASE SHIFTER HAVING A $V_3SI$ SUPERCONDUCTIVE SIGNAL LINE

[75] Inventor: Sadahiko Miura, Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/548,985

[22] Filed: Oct. 27, 1995

[30] Foreign Application Priority Data

Oct. 27, 1994 [JP] Japan ..... 6-263758

[51] Int. Cl.[7] ..... H01P 1/18; H01B 12/02

[52] U.S. Cl. ..... 505/210; 505/700; 505/701; 505/866; 333/99.5; 333/161

[58] Field of Search ..... 333/995, 161; 505/210, 700, 701, 866

[56] References Cited

U.S. PATENT DOCUMENTS

| | | | |
|---|---|---|---|
| 5,334,958 | 8/1994 | Babbitt et al. | 333/161 X |
| 5,409,889 | 4/1995 | Das | 333/161 X |
| 5,451,567 | 9/1995 | Das | 333/995 |
| 5,479,137 | 12/1995 | Koscica et al. | 333/161 X |

FOREIGN PATENT DOCUMENTS

| | | | |
|---|---|---|---|
| 2042787 | 2/1990 | Japan | 333/995 |

OTHER PUBLICATIONS

Adachi, H et al; "Highly oriented Hg–Ba–Ca–Cu–O Superconducting Thin Films"; *Applied Physics Letters*; vol. 63, No. 26; Dec. 27, 1993; pp. 3628–3629.

Moriwaki, Y. et al; "Epitoxial $HgBa_2$ $Ca_2$ $Cu_3$ Oy films on $SrTiO_3$ Substrate Prepared by Spray Pyrolysis Technique "; *Appl Phys Lett*; vol. 69, No. 22: Nov. 25, 1996; pp. 3423–3425.

Lyons W. G. et al; "Passive Microwave Device Applications of high tc Superconducting Thin Films"*Microwave Journal*-Nov. 1990 ; pp. 85–102.

J. Takemoto–Kobayashi et al., "Monolithic High–Tc Superconducting Phase Shifter at 10 GHz", IEEE,1992, pp. 469–472.

A. Findikoglu et al., "Effect of dc electric field on the effective microwave surface impedance of $YBa_2$ $Cu_3$ $O_7$ /$SrTiO_3$ /$YBa_2$ $Cu_3$ $O_7$ trilayers", Appl. Phys. Letter, Dec. 1993, vol. 63, No. 23, pp. 3215–3217.

*Primary Examiner*—Benny T. Lee
*Attorney, Agent, or Firm*—Young & Thompson

[57] ABSTRACT

The present invention provides a superconducting transmission delay line phase shifter which has an essential structure as follows. The superconducting transmission delay line phase shifter has a layer made of a material showing a low dielectric loss the layer comprising first, second and third sections, wherein the second section being positioned between the first and third sections. The superconducting transmission delay line phase shifter also has a ferroelectric selectively provided in the second section. The ferroelectric extends between boundaries of the second section to the first and third sections. The superconducting transmission delay line phase shifter also has a thin film made of a conductor having a high conductivity. The conductive thin film extends across the bottoms of the first, second and third sections. The superconducting transmission delay line phase shifter also has a superconducting signal transmission line, on which signals are transmitted. The superconducting signal transmission line comprises a signal input section, a phase shifting section jointed with the signal input section where transmission signals show phase shift in the phase shifting section, and a signal output section connected to the phase shifting section. The signal input section is at least in contact with the first section and the signal input section is level in relation to the top of the first section. The signal output section is at least in contact with the third section and the signal output section is level in relation to the top of the third section. The phase shifting section is at least in contact with the ferroelectric and the phase shifting section is level in relation to the top of the ferroelectric.

70 Claims, 7 Drawing Sheets

SUPERCONDUCTING TRANSMISSION LINE PHASE SHIFTER HAVING A $V_3SI$ SUPERCONDUCTIVE SIGNAL LINE

BACKGROUND OF THE INVENTION

The present invention relates to a superconducting transmission delay line phase shifter.

Phase shifters are one of the most important elements for phased array antenna. In the prior art, ferrite phase shifters have been used due to their high operation speed and a low energy loss. On the other hand, ferrite phase shifters have disadvantages by virtue of their large scale and large weights as well as complicated structures.

There has been known a PIN diode phase shifter having small weight, small scale, and low cost. On the other hand, PIN diode phase shifter shows a large insertion loss, for which reason it is necessary to provide an amplifier of the bottom stage of the delay circuit including the superconducting transmission delay line phase shifter.

There has been known a ceramic diode phase shift having small weight, small scale, and low cost. On the other hand, a ceramic diode phase shifter shows a large insert loss, for example, 5 dB.

Superconducting quantum interface devices (SQUIDs) have been known and disclosed in 1992 IEEE MIT-S Digest. Such a device suffers from the fact that a phase shift appears at a lower temperature than Tc.

A dielectric resonator having a copper cavity is disclosed in Applied Physics Letters Vol. 63, No. 23, 1993, wherein there is reported the effect of a dielectric field on the effective microwave surface impedance of $YBa_2Cu_3O_7/SrTiO_3/YBa_2Cu_3O_7$ trilayers. The resonant frequency controllable by controlling the electric field is only about 10 kHz. If the frequency to be used is 24 GHz, the resonator can show a slight phase shift of $1.5\times10^{-4}$ degrees, which is insufficient for realizing the actual phase shifter.

SUMMARY OF THE INVENTION

Accordingly, it is an object of the present invention to provide a novel superconducting transmission delay line phase shifter showing a large phase shift.

It is a further object of the present invention to provide a novel superconducting transmission delay line phase shifter showing an extremely low insertion loss.

It is a still further object of the present invention to provide a novel superconducting transmission delay line phase shifter monolithically integrated.

It is yet a further object of the present invention to provide a novel superconducting transmission delay line phase shifter which is reduced in scaled.

It is moreover an object of the present invention to provide a novel superconducting transmission delay line phase shifter showing excellent performance independent from a slight variation of temperature.

The above and other objects, features and advantages of the present invention will be apparent from the following descriptions.

The present invention provides a superconducting transmission delay line phase shifter which has an essential structure as follows. The superconducting transmission delay line phase shifter has a layer made of a material showing a low dielectric loss, the layer comprising first, second and third sections, wherein the second section is positioned between the first and third sections. The superconducting transmission delay line phase shifter also has a ferroelectric selectively provided in the second section. The ferroelectric extends between boundaries of the second section to the first and third sections. The superconducting transmission delay line phase shifter also has a thin film made of a conductor having a high conductivity. The conductive thin film extends across the bottoms of the first, second and third sections. The superconducting transmission delay line phase shifter also has a superconducting signal transmission line, on which signals are transmitted. The superconducting signal transmission line comprises a signal input section, a phase shifting section connected to the signal input section where transmission signals show phase shift in the phase shifting section, and a signal output section connected to the phase shifting section. The signal input section is at least in contact with the first section and the signal input section is level in relation to the top of the first section. The signal output section is at least in contact with the third section and the signal output section is level in relation to the top of the third section. The phase shifting section is at least in contact with the ferroelectric and the phase shifting section is level in relation to the top of the ferroelectric.

BRIEF DESCRIPTIONS OF THE DRAWINGS

Preferred embodiments of the present invention will be described in detail with reference to the accompanying drawings.

DETAILED DESCRIPTION OF THE INVENTION

Figure 1:
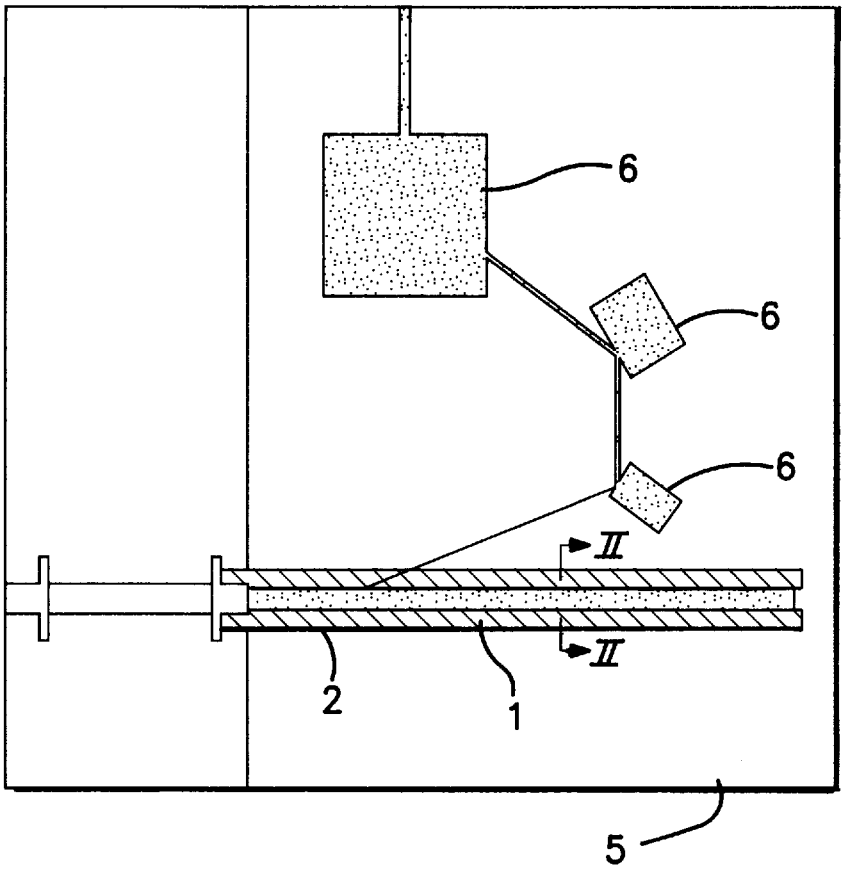
FIG. 1 is a plan view illustrative of a novel superconducting transmission delay line phase shifter in a fourteenth embodiment according to the present invention.

The present invention provides a superconducting transmission delay line phase shifter which has an essential structure as follows. The superconducting transmission delay line phase shifter has a layer made of a material showing a low dielectric loss, the layer comprising first, second and third sections, wherein the second section is positioned between the first and third sections. The superconducting transmission delay line phase shifter also has a ferroelectric selectively provided in the second section. The ferroelectric extends between boundaries of the second section to the first and third sections. The superconducting transmission delay line phase shifter also has a thin film made of a conductor having a high conductivity. The conductive thin film extends across the bottoms of the first, second and third sections. The superconducting transmission delay line phase shifter also has a superconducting signal transmission line, on which signals are transmitted. The superconducting signal transmission line comprises a signal input section, a phase shifting section jointed with the signal input section where transmission signals show phase shift in the phase shifting section, and a signal output section jointed with the phase shifting section. The signal input section is at least in contact with the first section and the signal input section is level in relation to the top of the first section. The signal output section is at least in contact with the third section and the signal output section is level in relation to the top of the third section. The phase shifting section is at least in contact with the ferroelectric and the phase shifting section is level in relation to the top of the ferroelectric.

Each of the signal input section, the signal output section, and the phase shifting section may be completely buried in its respective section, positioned with its top at the same level of the top of its respective section, or positioned with its top above a top of its respective section. The top of the ferroelectric may be positioned at the same level as the top of the layer.

Advantageously, the signal input section, the phase shifting section and the signal output section may be level with each other. Further advantageously, the superconducting signal transmission line may comprise a straight line.

Optionally, the ferroelectric may have the bottom positioned at the same level as the bottom of the layer so that the bottom is in contact with the thin film.

Alternatively, the ferroelectric may have the bottom positioned above the bottom of the layer so that the bottom of the ferroelectric is separated via the layer from the thin film.

It is preferable that the superconducting signal transmission line has a width and a distance from the thin film where the width and the distance are determined so that an impedance of the superconducting signal transmission line is set at about 50 Ω.

In the following descriptions, the variable "x" is used as a subscript for oxygen. This variable may represent without limitation, an integer no less than one and as great as seven or more. The superconducting signal transmission line may be made of any of $Y_1Ba_2Cu_3O_x$, $La_1Ba_2Cu_3O_x$, $Nd_1Ba_2Cu_3O_x$, $Eu_1Ba_2Cu_3O_x$, $Gd_1Ba_2Cu_3O_x$, $Dy_1Ba_2Cu_3O_x$, $Ho_1Ba_2Cu_3O_x$, $Er_1Ba_2Cu_3O_x$, $Yb_1Ba_2Cu_3O_x$, $Bi_2Sr_2Ca_1Cu_2O_x$, $Bi_2Sr_2Ca_2Cu_3O_x$, $Tl_2Ba_2Ca_1Cu_2O_x$, $Tl_2Ba_2Ca_2Cu_3O_x$, $Hg_2Ba_2Ca_1Cu_2O_x$, $Hg_2Ba_2Ca_2Cu_3O_x$, $Hg_1Ba_2Cl_1Cu_2O_x$, $Hg_1Ba_2Cl_2Cu_3O_x$, $La_1Sr_2Cu_3O_x$, $Nb_3Ge$, $Nb_3Ga$, $No_3Sn$, $V_3Si$, Nb, Pb, La-β, La-α, Al, Cd, Nb—Zr and Nb—Ti, $Y_1Ba_2Cu_3O_x$, $La_1Ba_2Cu_3O_x$, $Nd_1Ba_2Cu_3O_x$, $Eu_1Ba_2Cu_3O_x$, $Gd_1Ba_2Cu_3O_x$, $Dy_1Ba_2Cu_3O_x$, $Ho_1Ba_2Cu_3O_x$, $Er_1Ba_2Cu_3O_x$, and $Yb_1Ba_2Cu_3O_x$.

The thin film may be made of any superconductor such as $Bi_2Sr_2Ca_1Cu_2O_x$, $Bi_2Sr_2Ca_2Cu_3O_x$, $Tl_2Ba_2Ca_1Cu_2O_x$, $Tl_2Ba_2Ca_2Cu_3O_x$, $Hg_2Ba_2Ca_1Cu_2O_x$, $Hg_2Ba_2Ca_2Cu_3O_x$, $Hg_1Ba_2Cl_1Cu_2O_x$, $Hg_1Ba_2Cl_2Cu_3O_x$, $La_1Sr_2Cu_3O_x$, $Nb_3Ge$, $Nb_3Ga$, $Nb_3Sn$ and $V_3Si$, Nb, Pb, La-β, La-α, Al, Cd, Nb—Zr and Nb—Ti.

The layer may be made of $LaAlO_3$ or $NdAlO_3$. The ferroelectric may comprise $SrTiO_3$, $CaTiO_3$ or $NaTiO_3$.

It is optional to further provide a supporting substrate on which the superconducting transmission delay line phase shifter is provided. The supporting substrate may be made of $LaGaO_3$.

The superconducting signal transmission line and ground electrode are made of any one of $Y_1Ba_2Cu_3O_x$, $La_1Ba_2Cu_3O_x$, $Nd_1Ba_2Cu_3O_x$, $Eu_1Ba_2Cu_3O_x$, $Gd_1Ba_2Cu_3O_x$, $Dy_1Ba_2Cu_3O_x$, $Ho_1Ba_2Cu_3O_x$, $Er_1Ba_2Cu_3O_x$, $Yb_1Ba_2Cu_3O_x$, $Bi_2Sr_2Ca_1Cu_2O_x$, $Bi_2Sr_2Ca_2Cu_3O_x$, $Tl_2Ba_2Ca_1Cu_2O_x$, $Tl_2Ba_2Ca_2Cu_3O_x$, $Hg_2Ba_2Ca_1Cu_2O_x$, $Hg_2Ba_2Ca_2Cu_3O_x$, $Hg_1Ba_2Cl_1Cu_2O_x$, $Hg_1Ba_2Cl_2Cu_3O_x$, $La_1Sr_2Cu_3O_x$, $Nb_3Ge$, $Nb_3Ga$, $Nb_3Sn$, $V_3Si$, Nb, Pb, La-β, La-α, Al, Cd, Nb—Zr or Nb—Ti. The layer is made of $LaAlO_3$ or $NdAlO_3$. The ferroelectric comprises $SrTiO_3$, $CaTiO_3$ or $NaTiO_3$.

EMBODIMENTS

Figure 3:
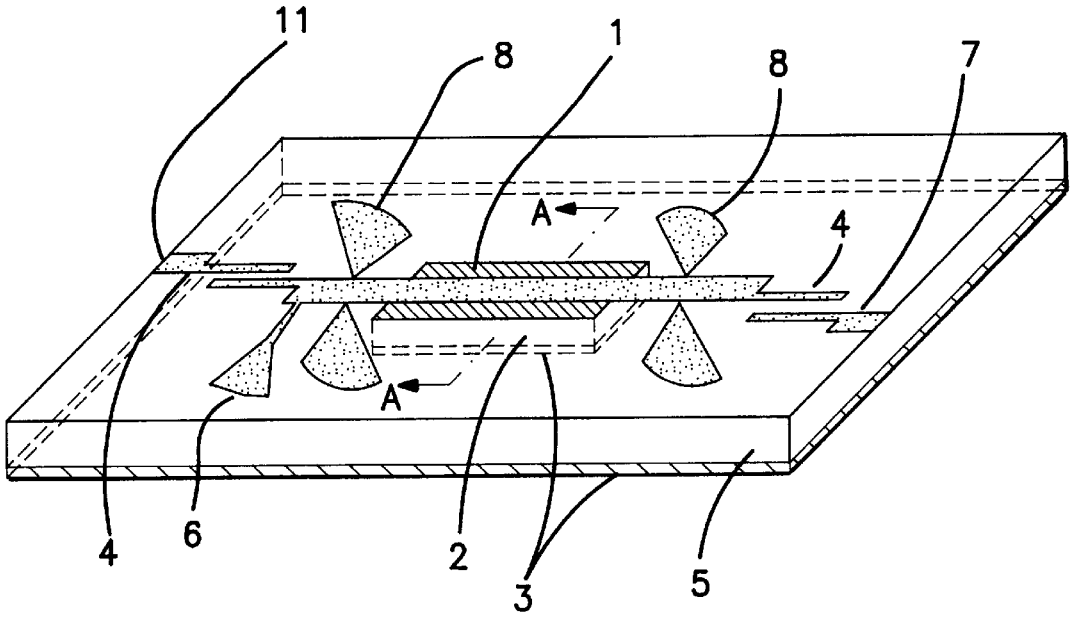
FIG. 3 is a perspective view illustrative of a novel superconducting transmission delay line phase shifter in first to sixth embodiments according to the present invention.
Figure 4:
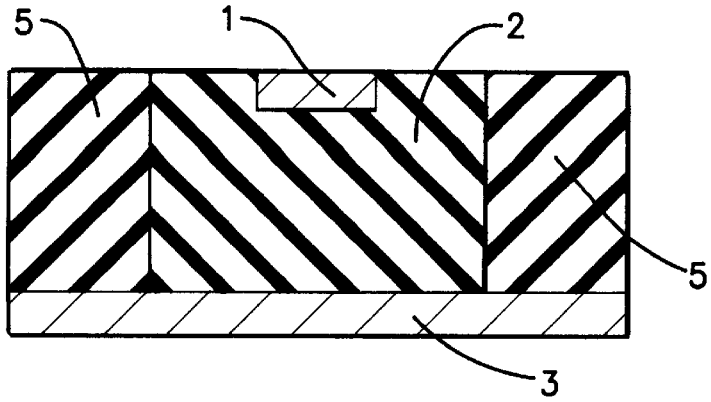
FIG. 4 is a cross sectional elevation view illustrative of a novel superconducting transmission delay line phase shifter in a first embodiment according to the present invention.

A first embodiment according to the present invention will be described in detail with reference to FIGS. 3 and 4. FIG. 3 illustrates a micro-strip superconducting signal transmission line phase shifter which is monolithically integrated on a $LaAlO_3$ monocrystal layer 5. The $LaAlO_3$ monocrystal layer 5 shows a low dielectric loss. The $LaAlO_3$ monocrystal layer 5 illustrated has a rectangular shape. The $LaAlO_3$ monocrystal layer 5 comprises three sections. The first section is a signal input section positioned at a side of the signal input. The second section is a phase shifting section positioned at an intermediate of the $LaAlO_3$ monocrystal layer 5. The third section is a signal output section positioned at a side of the signal output. A superconductor ground electrode 3 made of $Y_1Ba_2Cu_3O_x$ is provided on an entire part of the bottom of the $LaAlO_3$ monocrystal layer 5. A $SrTiO_3$ monocrystal ferroelectric 2 is selectively provided in the second section or the phase shifting section of the $LaAlO_3$ monocrystal layer 5. The $SrTiO_3$ monocrystal ferroelectric 2 extends between boundaries of the phase shifting section to the signal input and output sections of the $LaAlO_3$ monocrystal layer 5. The $SrTiO_3$ monocrystal ferroelectric 2 has the same thickness as the $LaAlO_3$ monocrystal layer 5. The bottom of the $SrTiO_3$ monocrystal ferroelectric 2 is positioned at the same level as the bottom of the $LaAlO_3$ monocrystal layer 5 so that the bottom of the $SrTiO_3$ monocrystal ferroelectric 2 is in contact with the top of the superconductor ground electrode 3 made of $Y_1Ba_2Cu_3O_x$. A $Y_1Ba_2Cu_3O_x$ superconducting signal transmission line 1 is provided to extend on the top surface of the $LaAlO_3$ monocrystal layer 5 in a longitudinal direction of the rectangular-shaped $LaAlO_3$ monocrystal layer 5. The $Y_1Ba_2Cu_3O_x$ superconducting signal transmission line 1 comprises a straight line across the signal input section, the $SrTiO_3$ monocrystal ferroelectric 2, and the signal output section. The $Y_1Ba_2Cu_3O_x$ superconducting signal transmission line 1 is not completely buried in the $SrTiO_3$ monocrystal ferroelectric 2 and the $LaAlO_3$ monocrystal layer 5. The top of the $Y_1Ba_2Cu_3O_x$ superconducting signal transmission line 1 has the same level as the top of the $SrTiO_3$ monocrystal ferroelectric 2 and the $LaAlO_3$ monocrystal layer 5. The $Y_1Ba_2Cu_3O_x$ superconducting signal transmission line 1 has a width and a distance from the top of the $Y_1Ba_2Cu_3O_x$ superconductor ground electrode 3, wherein the width and the distance are determined so that an impedance of the $Y_1Ba_2Cu_3O_x$ superconducting signal transmission line 1 is set at 50 Ω.

Impedance adjusters 8 are provided in the signal input section and the signal output section of the $LaAlO_3$ monocrystal layer 5. In the signal input section of the $LaAlO_3$ monocrystal layer 5, the impedance adjusters 8 are provided at opposite sides of the $Y_1Ba_2Cu_3O_x$ superconducting signal transmission line 1. Each of the impedance adjusters 8 is coupled to the $Y_1Ba_2Cu_3O_x$ superconducting thin film. Each of the impedance adjusters 8 is fan-shaped and not completely buried in the signal input section of the $LaAlO_3$ monocrystal layer 5. In the signal output section of the $LaAlO_3$ monocrystal layer 5, the impedance adjusters 8 are provided at opposite sides of the $Y_1Ba_2Cu_3O_x$ superconducting signal transmission line 1. Each of the impedance adjusters 8 is coupled to the $Y_1Ba_2Cu_3O_x$ superconducting signal transmission line 1. Each of the impedance adjusters 8 is fan-shaped and not completely buried in the signal output section of the $LaAlO_3$ monocrystal layer 5. The $Y_1Ba_2Cu_3O_x$ superconducting impedance adjuster 8 serves to prevent any reflection of the signal.

An RF filter 6 is provided in the signal input section of the $LaAlO_3$ monocrystal layer 5. The RF filter 6 is coupled to the $Y_1Ba_2Cu_3O_x$ superconducting signal transmission line 1. A bias voltage is applied, by a dc power supply not illustrated, between the RF filter 6 and the $Y_1Ba_2Cu_3O_x$ superconductor ground electrode 3. The RF filter 6 serves as a low pass filter which prevents the high frequency signals from transmitting to the dc power supply.

An input terminal 11 is provided in the signal input section of the $LaAlO_3$ monocrystal layer 5. The input terminal 11 is made of $Y_1Ba_2Cu_3O_x$ superconductor.

An output terminal 7 is provided in the signal output section of the $LaAlO_3$ monocrystal layer 5. The output terminal 7 is made of $Y_1Ba_2Cu_3O_x$ superconductor.

In the signal input section of the $LaAlO_3$ monocrystal layer 5, a capacitor 4 is provided between the input terminal 11 and the end of the superconducting signal transmission line 1 in the signal input section of the $LaAlO_3$ monocrystal layer 5. In the signal output section of the $LaAlO_3$ monocrystal layer 5, a capacitor 4 is provided between the output terminal 7 and the end of the superconducting signal transmission line 1 in the signal output section of the $LaAlO_3$ monocrystal layer 5. The capacitor 4 in the signal input section serves to prevent the dc voltage applied on the superconducting signal transmission line 1 from transmitting to the signal input terminal 11. The capacitor 4 in the signal output section serves to prevent the dc voltage applied on the superconducting signal transmission line 1 from transmitting to the signal output terminal 7. The capacitor 4 comprises two part parallel lines arranged in parallel to each other. The capacitor 4 is made of $Y_1Ba_2Cu_3O_x$ superconductor. The input and output terminals 11 and 7 are made of $Y_1Ba_2Cu_3O_x$ superconductor.

The above superconducting signal transmission line phase shifter was cooled down to a temperature, at which nitrogen is kept in liquid state, to confirm the transparent/reflection performances of the above superconducting signal transmission line phase shifter. In a frequency range of 3.5 GHz–4.5 GHz, an insertion loss ($S_{21}$) is not more than 1 dB and a reflection coefficient ($S_{11}$) is not less than 15 dB. When an electric field of 2 V/μm is applied onto the $SrTiO_3$ monocrystal ferroelectric 2, the signals in the frequency range of 3.5 GHz–4.5 GHz show a phase shift of about 40 degrees.

Figure 5:
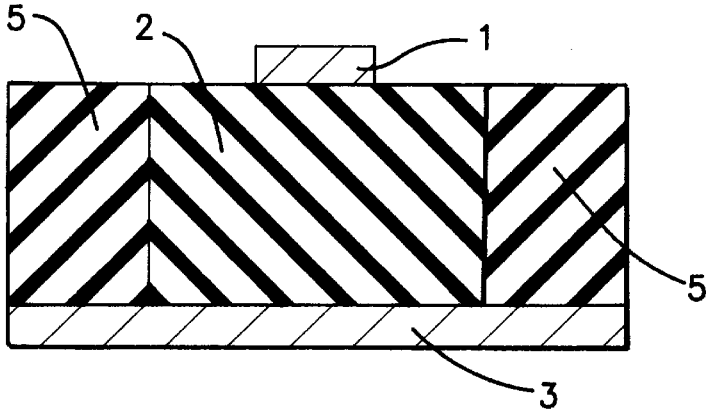
FIG. 5 is a cross sectional elevation view illustrative of a novel superconducting transmission delay line phase shifter in a second embodiment according to the present invention.

A second embodiment is shown in FIG. 5. The $Y_1Ba_2Cu_3O_x$ superconducting signal transmission line 1 is not buried in the $SrTiO_3$ monocrystal ferroelectric 2 and the $LaAlO_3$ monocrystal layer 5. The top of the $Y_1Ba_2Cu_3O_x$ superconducting signal transmission line 1 is positioned above the top of the $SrTiO_3$ monocrystal ferroelectric 2 and the $LaAlO_3$ monocrystal layer 5.

Figure 6:
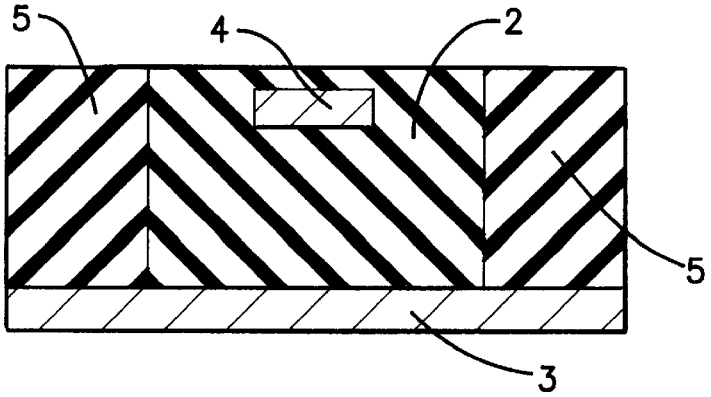
FIG. 6 is a cross sectional elevation view illustrative of a novel superconducting transmission delay line phase shifter in a third embodiment according to the present invention.

A third embodiment is shown in FIG. 6. A $Y_1Ba_2Cu_3O_x$ superconducting signal transmission line 1 is provided to extend under the top surface of the $LaAlO_3$ monocrystal layer 5 in a longitudinal direction of the rectangular-shaped $LaAlO_3$ monocrystal layer 5. The $Y_1Ba_2Cu_3O_x$ superconducting signal transmission line 1 comprises a straight line across the signal input section, the $SrTiO_3$ monocrystal ferroelectric 2 the signal input section. The $Y_1Ba_2Cu_3O_x$ superconducting signal transmission line 1 is completely buried in the $SrTiO_3$ monocrystal ferroelectric 2 and the $LaAlO_3$ monocrystal layer 5. The top of the $Y_1Ba_2Cu_3O_x$ superconducting signal transmission line 1 is positioned below the top of the $SrTiO_3$ monocrystal ferroelectric 2 and the $LaAlO_3$ monocrystal layer 5.

Figure 7:
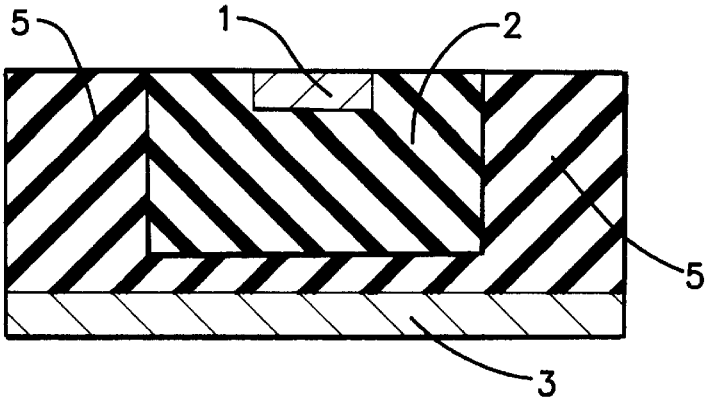
FIG. 7 is a cross sectional elevation view illustrative of a novel superconducting transmission delay line phase shifter in a fourth embodiment according to the present invention.

A fourth embodiment is shown in FIG. 7. The $SrTiO_3$ monocrystal ferroelectric 2 has a smaller thickness than a thickness of the $LaAlO_3$ monocrystal layer 5. The bottom of the $SrTiO_3$ monocrystal ferroelectric 2 is positioned above the bottom of the $LaAlO_3$ monocrystal layer 5 so that the bottom of the $SrTiO_3$ monocrystal ferroelectric 2 is separated via the $LaAlO_3$ monocrystal layer 5 from the top of the superconductor ground electrode 3 made of $Y_1Ba_2Cu_3O_x$. A $Y_1Ba_2Cu_3O_x$ superconducting signal transmission line 1 is provided to extend in the top surface of the $LaAlO_3$ monocrystal layer 5 in a longitudinal direction of the rectangular-shaped $LaAlO_3$ monocrystal layer 5. The $Y_1Ba_2Cu_3O_x$ superconducting signal transmission line 1 comprises a straight line across the signal input section, the $SrTiO_3$ monocrystal ferroelectric 2 the signal input section. The $Y_1Ba_2Cu_3O_x$, superconducting signal transmission line 1 is not completely buried in the $SrTiO_3$ monocrystal ferroelectric 2 and the $LaAlO_3$ monocrystal layer 5. The top of the $Y_1Ba_2Cu_3O_x$ superconducting signal transmission line 1 has the same level as the top of the $SrTiO_3$ monocrystal ferroelectric 2 and the $LaAlO_3$ monocrystal layer 5. In this case, it is required to apply the bias voltage higher than the necessary voltage in the first embodiment since the ferroelectric is separated via the $LaAlO_3$ monocrystal layer 5 from the $Y_1Ba_2Cu_3O_x$ superconducting ground electrode. In a frequency range of 3.5 GHz–4.5 GHz, an insertion loss ($S_{21}$) is not more than 1 dB and a reflection coefficient ($S_{11}$) is not less than 15 dB. When an electric field of 2 V/$\mu$m is applied onto the $SrTiO_3$ monocrystal ferroelectric 2, the signals in the frequency range of 3.5 GHz–4.5 GHz show a phase shift of about 40 degrees.

Figure 8:
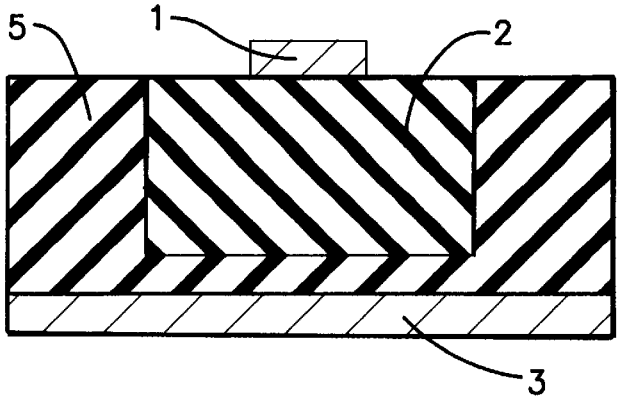
FIG. 8 is a cross sectional elevation view illustrative of a novel superconducting transmission delay line phase shifter in a fifth embodiment according to the present invention.

A fifth embodiment is shown in FIG. 8. As in the fourth embodiment, the $SrTiO_3$ monocrystal ferroelectric 2 has a smaller thickness than a thickness of the $LaAlO_3$ monocrystal layer 5. A $Y_1Ba_2Cu_3O_x$ superconducting signal transmission line 1 is provided to extend on the top surface of the $LaAlO_3$ monocrystal layer 5 in a longitudinal direction of the rectangular-shaped $LaAlO_3$ monocrystal layer 5. The $Y_1Ba_2Cu_3O_x$ superconducting signal transmission line 1 comprises a straight line across the signal input section, the $SrTiO_3$ monocrystal ferroelectric 2 the signal input section. The $Y_1Ba_2Cu_3O_x$ superconducting signal transmission line 1 is not buried in the $SrTiO_3$ monocrystal ferroelectric 2 and the $LaAlO_3$ monocrystal layer 5. The top of the $Y_1Ba_2Cu_3O_x$ superconducting signal transmission line 1 is positioned above the top of the $SrTiO_3$ monocrystal ferroelectric 2 and the $LaAlO_3$ monocrystal layer 5. In this case, it is required to apply a bias voltage higher than the necessary bias voltage in the second embodiment. In a frequency range of 3.5 GHz–4.5 GHz, an insertion loss ($S_{21}$) is not more than $_1$ dB and a reflection coefficient ($S_{11}$) is not less than 15 dB. When an electric filed of 2 V/$\mu$m is applied onto the $SrTiO_3$ monocrystal ferroelectric 2, the signals in the frequency range of 3.5 GHz–4.5 GHz show a phase shift of about 40 degrees.

Figure 9:
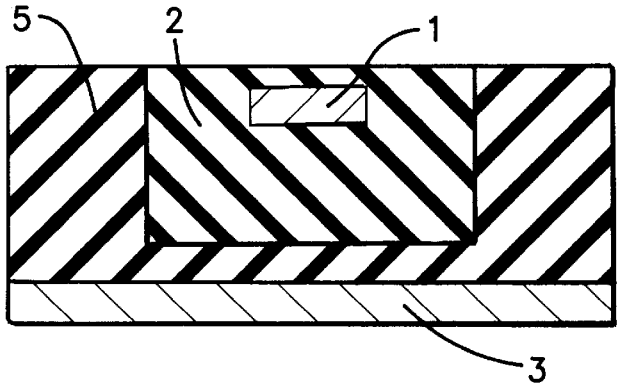
FIG. 9 is a cross sectional elevation view illustrative of a novel superconducting transmission delay line phase shifter in a sixth embodiment according to the present invention.

A sixth embodiment is shown in FIG. 9. The $SrTiO_3$ monocrystal ferroelectric 2 has a smaller thickness than a thickness of the $LaAlO_3$ monocrystal layer 5. The bottom of the $SrTiO_3$ monocrystal ferroelectric 2 is positioned above the bottom of the $LaAlO_3$ monocrystal layer 5 so that the bottom of the $SrTiO_3$ monocrystal ferroelectric 2 is separated via the $LaAlO_3$ monocrystal layer 5 from the top of the superconductor ground electrode 3 made of $Y_1Ba_2Cu_3O_x$. A $Y_1Ba_2Cu_3O_x$ superconducting signal transmission line 1 is provided to extend under the top surface of the $LaAlO_3$ monocrystal layer 5 in a longitudinal direction of the rectangular-shaped $LaAlO_3$ monocrystal layer 5. The $Y_1Ba_2Cu_3O_x$ superconducting signal transmission line 1 comprises a straight line across the signal input section, the $SrTiO_3$ monocrystal ferroelectric 2 the signal input section. The $Y_1Ba_2Cu_3O_x$ superconducting signal transmission line 1 is completely buried in the $SrTiO_3$ monocrystal ferroelectric 2 and the $LaAlO_3$ monocrystal layer 5. The top of the $Y_1Ba_2Cu_3O_x$ superconducting signal transmission line 1 is positioned below the top of the $SrTiO_3$ monocrystal ferroelectric 2 and the $LaAlO_3$ monocrystal layer 5. In this case, it is required to apply a higher bias voltage than the bias voltage needed in the third embodiment. In a frequency range of 3.5 GHz–4.5 GHz, an insertion loss ($S_{21}$) is not more than 1 dB and a reflection coefficient ($S_{11}$) is not less than 15 dB. When an electric field of 2 V/$\mu$m is applied onto the $SrTiO_3$ monocrystal ferroelectric 2, the signals in the frequency range of 3.5 GHz–4.5 GHz show a phase shift of about 40 degrees.

Figure 10:
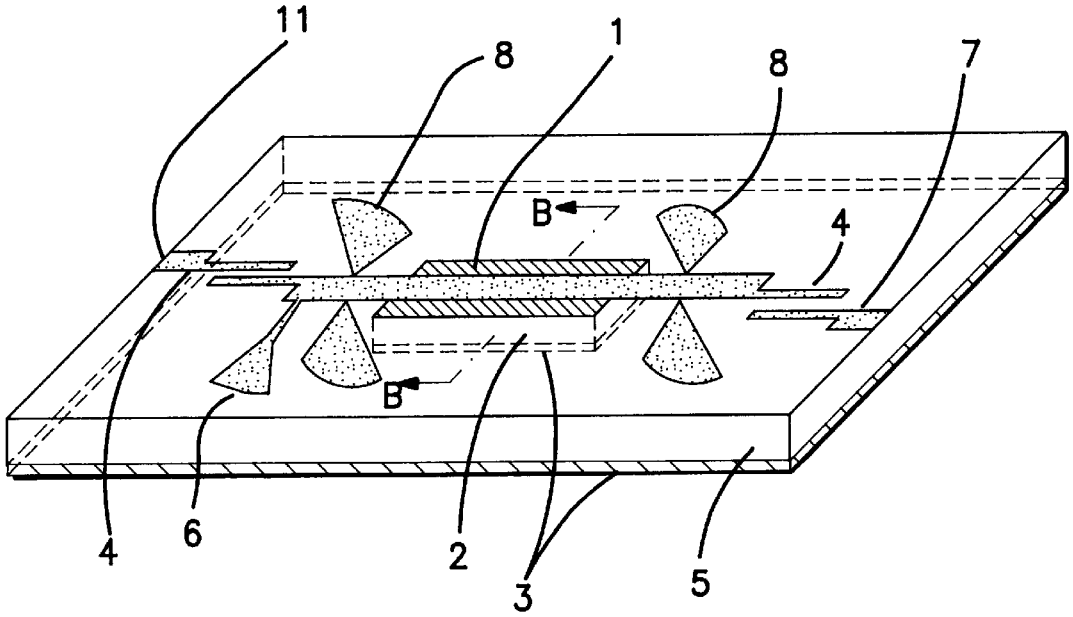
FIG. 10 is a perspective view illustrative of a novel superconducting transmission delay line phase shifter in seventh to twelfth embodiments according to the present invention.
Figure 11:
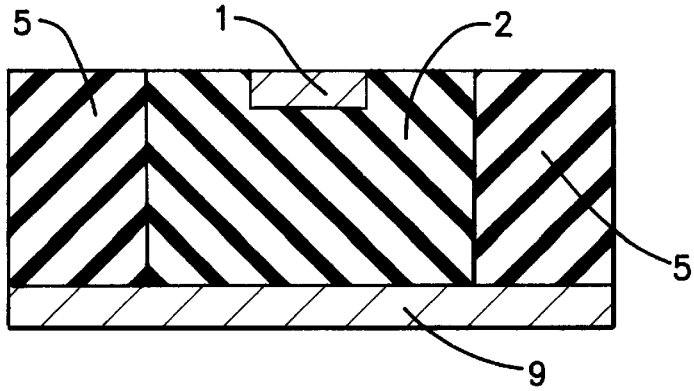
FIG. 11 is a cross sectional elevation view illustrative of a novel superconducting transmission delay line phase shifter in a seventh embodiment according to the present invention.

A seventh embodiment according to the present invention will be described in detail with reference to FIGS. 10 and 11. FIG. 10 illustrates a micro-strip superconducting signal transmission line phase shifter which is monolithically integrated on a $NdAlO_3$ monocrystal layer 5. The $NdAlO_3$ monocrystal layer 5 shows a low dielectric loss. The $NdAlO_3$ monocrystal layer 5 illustrated has a rectangular shape. The $NdAlO_3$ monocrystal layer 5 comprises three sections. The first section is a signal input section positioned at a side of the signal input. The second section is a phase shifting section positioned at an intermediate of the $NdAlO_3$ monocrystal layer 5. The third section is a signal output section positioned at a side of the signal output. A metal ground electrode 9 made of Au is provided on an entire part of the bottom of the $NdAlO_3$ monocrystal layer 5. A $SrTiO_3$ monocrystal ferroelectric 2 is selectively provided in the second section or the phase shifting section of the $NdAlO_3$ monocrystal layer 5. The $SrTiO_3$ monocrystal ferroelectric 2 extends between boundaries of the phase shifting section to the signal input and output sections of the $NdAlO_3$ monocrystal layer 5. The $SrTiO_3$ monocrystal ferroelectric 2 has the same thickness as the $NdAlO_3$ monocrystal layer 5. The bottom of the $SrTiO_3$ monocrystal ferroelectric 2 is positioned at the same level as the bottom of the $NdAlO_3$ monocrystal layer 5 so that the bottom of the $SrTiO_3$ monocrystal ferroelectric 2 is in contact with the top of the metal ground electrode 9 made of Au. A $Y_1Ba_2Cu_3O_x$ superconducting signal transmission line 1 is provided to extend on the top surface of the $NdAlO_3$ monocrystal layer 5 in a longitudinal direction of the rectangular-shaped $NdAlO_3$ monocrystal layer 5. The $Y_1Ba_2Cu_3O_x$ superconducting signal transmission line 1 comprises a straight line across the signal input section, the $SrTiO_3$ monocrystal ferroelectric 2 the signal input section. The $Y_1Ba_2Cu_3O_x$ superconducting signal transmission line 1 is not completely buried in the $SrTiO_3$ monocrystal ferroelectric 2 and the $NdAlO_3$ monocrystal layer 5. The top of the $Y_1Ba_2Cu_3O_x$ superconducting signal transmission line 1 has the same level as the top of the $SrTiO_3$ monocrystal ferroelectric 2 and the $NdAlO_3$ monocrystal layer 5. The $Y_1Ba_2Cu_3O_x$ superconducting signal transmission line 1 has a width and a distance from the top of the Au metal ground electrode 9, wherein the width and the distance are determined so that an impedance of the $Y_1Ba_2Cu_3O_x$ superconducting signal transmission line 1 is set at 50 Ω.

Impedance adjusters 8 are provided in the signal input section and the signal output section of the $NdAlO_3$ monocrystal layer 5. In the signal input section of the $NdAlO_3$ monocrystal layer 5, the impedance adjusters 8 are provided at opposite sides of the $Y_1Ba_2Cu_3O_x$ superconducting signal transmission line 1. Each of the impedance adjusters 8 is coupled to the $Y_1Ba_2Cu_3O_x$ superconducting thin film. Each of the impedance adjusters 8 is fan-shaped and not completely buried in the signal input section of the $NdAlO_3$ monocrystal layer 5. In the signal output section of the $NdAlO_3$ monocrystal layer 5, the impedance adjusters 8 are provided at opposite sides of the $Y_1Ba_2Cu_3O_x$ superconducting signal transmission line 1. Each of the impedance adjusters 8 is coupled to the $Y_1Ba_2Cu_3O_x$ superconducting signal transmission line 1. Each of the impedance adjusters 8 is fan-shaped and not completely buried in the signal output section of the $NdAlO_3$ monocrystal layer 5. The $Y_1Ba_2Cu_3O_x$ superconducting impedance adjuster 8 serves to prevent any reflection of the signal.

An RF filter 6 is provided in the signal output section of the $NdAlO_3$ monocrystal layer 5. The RF filter 6 is coupled to the $Y_1Ba_2Cu_3O_x$ superconducting signal transmission line 1. A bias voltage is applied, by a dc power supply not illustrated, between the RF filter 6 and Au metal ground electrode 9. The RF filter 6 serves as a low pass filter which prevents the high frequency signals from transmitting to the dc power supply.

An input terminal 11 is provided in the signal input section of the $NdAlO_3$ monocrystal layer 5. The input terminal 11 is made of $Y_1Ba_2Cu_3O_x$ superconductor.

An output terminal 7 is provided in the signal output section of the $NdAlO_3$ monocrystal layer 5. The output terminal 7 is made of $Y_1Ba_2Cu_3O_x$ superconductor.

In the signal input section of the $NdAlO_3$ monocrystal layer 5, a capacitor 4 is provided between the input terminal 11 and the end of the superconducting signal transmission line 1 in the signal input section of the $NdAlO_3$ monocrystal layer 5. In the signal output section of the $NdAlO_3$ monocrystal layer 5, a capacitor 4 is provided between the output terminal 7 and the end of the superconducting signal transmission line 1 in the signal output section of the $NdAlO_3$ monocrystal layer 5. The capacitor 4 in the signal input section serves to prevent the dc voltage applied on the superconducting signal transmission line 1 from transmitting to the signal input terminal 11. The capacitor 4 in the signal output section serves to prevent the dc voltage applied on the superconducting signal transmission line 1 from transmitting to the signal output terminal 7. The capacitor 4 comprises two part parallel lines arranged in parallel to each other. The capacitor 4 is made of $Y_1Ba_2Cu_3O_x$ superconductor. The input terminal 11 and the output terminal 7 are made of $Y_1Ba_2Cu_3O_x$ superconductor.

The above superconducting signal transmission line phase shifter was cooled down to a temperature, at which nitrogen is kept in liquid state, to confirm the transparent/reflection performances of the above superconducting signal transmission line phase shifter. In a frequency range of 3.5 GHz–4.4 GHz, an insertion loss ($S_{21}$) is about 2 dB and a reflection coefficient ($S_{11}$) is not less than 15 dB. When an electric field of 2 V/)$\mu$m is applied onto the $SrTiO_3$ monocrystal ferroelectric 2, the signals in the frequency range of 3.5 GHz–4.4 GHz show a phase shift of about 40 degrees.

Figure 12:
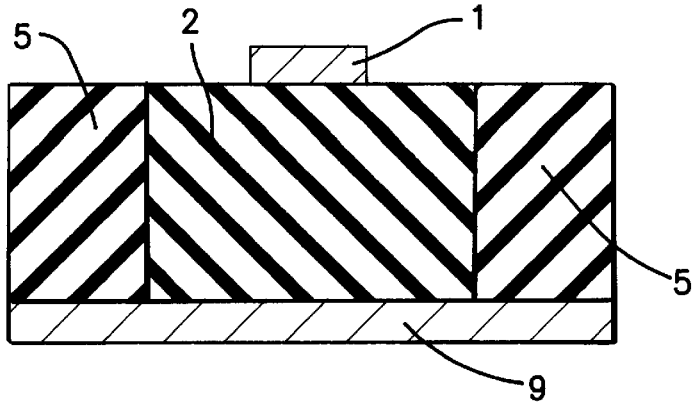
FIG. 12 is a cross sectional elevation view illustrative of a novel superconducting transmission delay line phase shifter in an eighth embodiment according to the present invention.

An eighth embodiment is shown in FIG. 12. A $Y_1Ba_2Cu_3O_x$ superconducting signal transmission line 1 is provided to extend on the top surface of the $NdAlO_3$ monocrystal layer 5 in a longitudinal direction of the rectangular-shaped $NdAlO_3$ monocrystal layer 5. The $Y_1Ba_2Cu_3O_x$ superconducting signal transmission line 1 comprises a straight line across the signal input section, the $SrTiO_3$ monocrystal ferroelectric 2 the signal input section. The $Y_1Ba_2Cu_3O_x$ superconducting signal transmission line 1 is not buried in the $SrTiO_3$ monocrystal ferroelectric 2 and the $NdAlO_3$ monocrystal layer 5. The top of the $Y_1Ba_2Cu_3O_x$ superconducting signal transmission line 1 is positioned above the top of the $SrTiO_3$ monocrystal ferroelectric 2 and the $NdAlO_3$ monocrystal layer 5.

Figure 13:
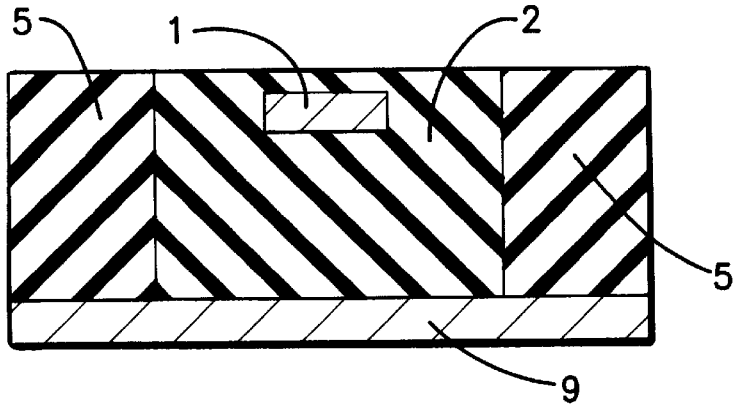
FIG. 13 is a cross sectional elevation view illustrative of a novel superconducting transmission delay line phase shifter in a ninth embodiment according to the present invention.

A ninth embodiment is shown in FIG. 13. A $Y_1Ba_2Cu_3O_x$ superconducting signal transmission line 1 is provided to extend under the top surface of the $NdAlO_3$ monocrystal layer 5 in a longitudinal direction of the rectangular-shaped $NdAlO_3$ monocrystal layer 5. The $Y_1Ba_2Cu_3O_x$ superconducting signal transmission line 1 comprises a straight line across the signal input section, the $SrTiO_3$ monocrystal ferroelectric 2 the signal input section. The $Y_1Ba_2Cu_3O_x$ superconducting signal transmission line 1 is completely buried in the $SrTiO_3$ monocrystal ferroelectric 2 and the $NdAlO_3$ monocrystal layer 5. The top of the $Y_1Ba_2Cu_3O_x$ superconducting signal transmission line 1 is positioned below the top of the $SrTiO_3$ monocrystal ferroelectric 2 and the $NdAlO_3$ monocrystal layer 5.

Figure 14:
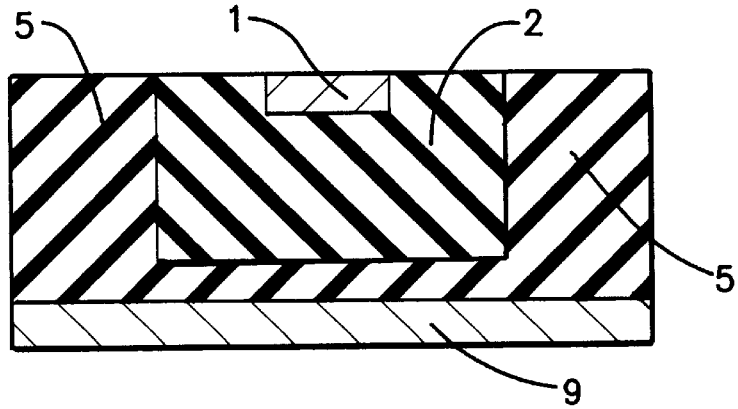
FIG. 14 is a cross sectional elevation view illustrative of a novel superconducting transmission delay line phase shifter in a tenth embodiment according to the present invention.

A tenth embodiment is shown in FIG. 14. The $SrTiO_3$ monocrystal ferroelectric 2 has a smaller thickness than a thickness of the $NdAlO_3$ monocrystal layer 5. The bottom of the $SrTiO_3$ monocrystal ferroelectric 2 is positioned above the bottom the $NdAlO_3$ monocrystal layer 5 so that the bottom of the $SrTiO_3$ monocrystal ferroelectric 2 is separated via the $NdAlO_3$ monocrystal layer 5 from the top of the metal ground electrode 9 made of Au. A $Y_1Ba_2Cu_3O_x$ superconducting signal transmission line 1 is provided to extend in the top surface of the $NdAlO_3$ monocrystal layer 5 in a longitudinal direction of the rectangular-shaped $NOAlO_3$ monocrystal layer 5. The $Y_1Ba_2Cu_3O_x$ superconducting signal transmission line 1 comprises a straight line across the signal input section, the $SrTiO_3$ monocrystal ferroelectric 2 the signal input section. The $Y_1Ba_2Cu_3O_x$ superconducting signal transmission line 1 is completely buried in the $SrTiO_3$ monocrystal ferroelectric 2 and the $NdAlO_3$ monocrystal layer 5. The top of the $Y_1Ba_2Cu_3O_x$ superconducting signal transmission line 1 has the same level as the top of the $SrTiO_3$ monocrystal ferroelectric 2 and the $NdAlO_3$ monocrystal layer 5.

The above superconducting signal transmission line phase shifter was cooled down to a temperature, at which nitrogen is kept in liquid state, to confirm the transparent/reflection performances of the above superconducting signal transmission line phase shifter. In this case, it is required to apply the bias voltage higher than the necessary voltage in the first embodiment since the ferroelectric is separated via the $NdAlO_3$ monocrystal layer 5 from the $Y_1Ba_2Cu_3O_x$ metal ground electrode. In a frequency range of 3.5 GHz–4.4 GHz, an insertion loss ($S_{21}$) is about 2 dB and reflection coefficient ($S_{11}$) is not less than 15 dB. When an electric field of 2 V/$\mu$m is applied onto the $SrTiO_3$ monocrystal ferroelectric 2, the signals in the frequency range of 3.5 GHz–4.4 GHz show a phase shift of about 40 degrees.

Figure 15:
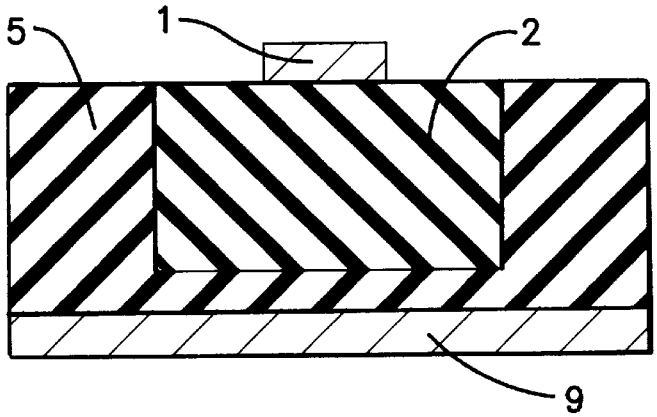
FIG. 15 is a cross sectional elevation view of a novel superconducting transmission delay line phase shifter in an eleventh embodiment according to the present invention.

An eleventh embodiment is shown in FIG. 15. A $Y_1Ba_2Cu_3O_x$ superconducting signal transmission line 1 is provided to extend on the top surface of the $NdAlO_3$ monocrystal layer 5 in a longitudinal direction of the rectangular-shaped $NdAlO_3$ monocrystal layer 5. The $Y_1Ba_2Cu_3O_x$ superconducting signal transmission line 1 comprises a straight line across the signal input section, the $SrTiO_3$ monocrystal ferroelectric 2 the signal input section. The $Y_1Ba_2Cu_3O_x$ superconducting signal transmission line 1 is not buried in the $SrTiO_3$ monocrystal ferroelectric 2 and the $NdAlO_3$ monocrystal layer 5. The top of the $Y_1Ba_2Cu_3O_x$ superconducting signal transmission line 1 is positioned above the top of the $SrTiO_3$ monocrystal ferroelectric 2 and the $NdAlO_3$ monocrystal layer 5.

The above superconducting signal transmission line phase shifter was cooled down to a temperature, at which nitrogen is kept in liquid state, to confirm the transparent/reflection performances of the above superconducting signal transmission line phase shifter. In this case, it is required to apply a bias voltage higher than the necessary bias voltage in the second embodiment. In a frequency range of 3.5 GHz–4.4 GHz, an insertion loss ($S_{21}$) is about 2 dB and a reflection coefficient ($S_{11}$) is not less than 15 dB. When an electric field of 2 V/$\mu$m is applied onto the $SrTiO_3$ monocrystal ferroelectric 2, the signals in the frequency range of 3.5 GHz–4.4 GHz show a phase shift of about 40 degrees.

Figure 16:
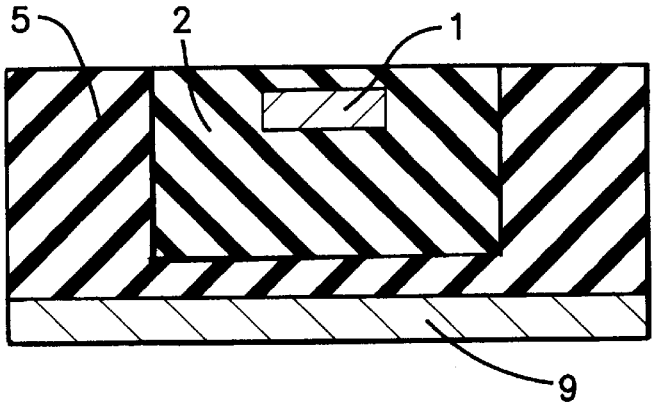
FIG. 16 is a cross sectional elevation view illustrative of a novel superconducting transmission delay line phase shifter in a twelfth embodiment according to the present invention.

A twelfth embodiment is shown in FIG. 16. A $Y_1Ba_2Cu_3O_x$ superconducting signal transmission line 1 is provided to extend under the top surface of the $NdAlO_3$ monocrystal layer 5 in a longitudinal direction of the rectangular-shaped $NdAlO_3$ monocrystal layer 5. The $Y_1Ba_2Cu_3O_x$ superconducting signal transmission line 1 comprises a straight line across the signal input section, the $SrTiO_3$ monocrystal ferroelectric 2 the signal input section. The $Y_1Ba_2Cu_3O_x$ superconducting signal transmission line 1 is completely buried in the $SrTiO_3$ monocrystal ferroelectric 2 and the $NdAlO_3$ monocrystal layer 5. The top of the $Y_1Ba_2Cu_3O_x$ superconducting signal transmission line 1 is positioned below the top of the $SrTiO_3$ monocrystal ferroelectric 2 and the $NdAlO_3$ monocrystal layer 5.

The above superconducting signal transmission line phase shifter was cooled down to a temperature, at which nitrogen is kept in liquid state, to confirm the transparent/reflection performances of the above superconducting signal transmission line phase shifter. In this case, it is required to apply a higher bias voltage than the bias voltage needed in the third embodiment. In a frequency range of 3.5 GHz–4.4 GHz, an insertion loss ($S_{21}$) is about 2 dB and a reflection coefficient ($S_{11}$) is not less than 15 dB. When an electric field of 2 V/$\mu$m is applied onto the $SrTiO_3$ monocrystal ferroelectric 2, the signals in the frequency range of 3.5 GHz–4.4 GHz show a phase shift of about 40 degrees.

Figure 17:
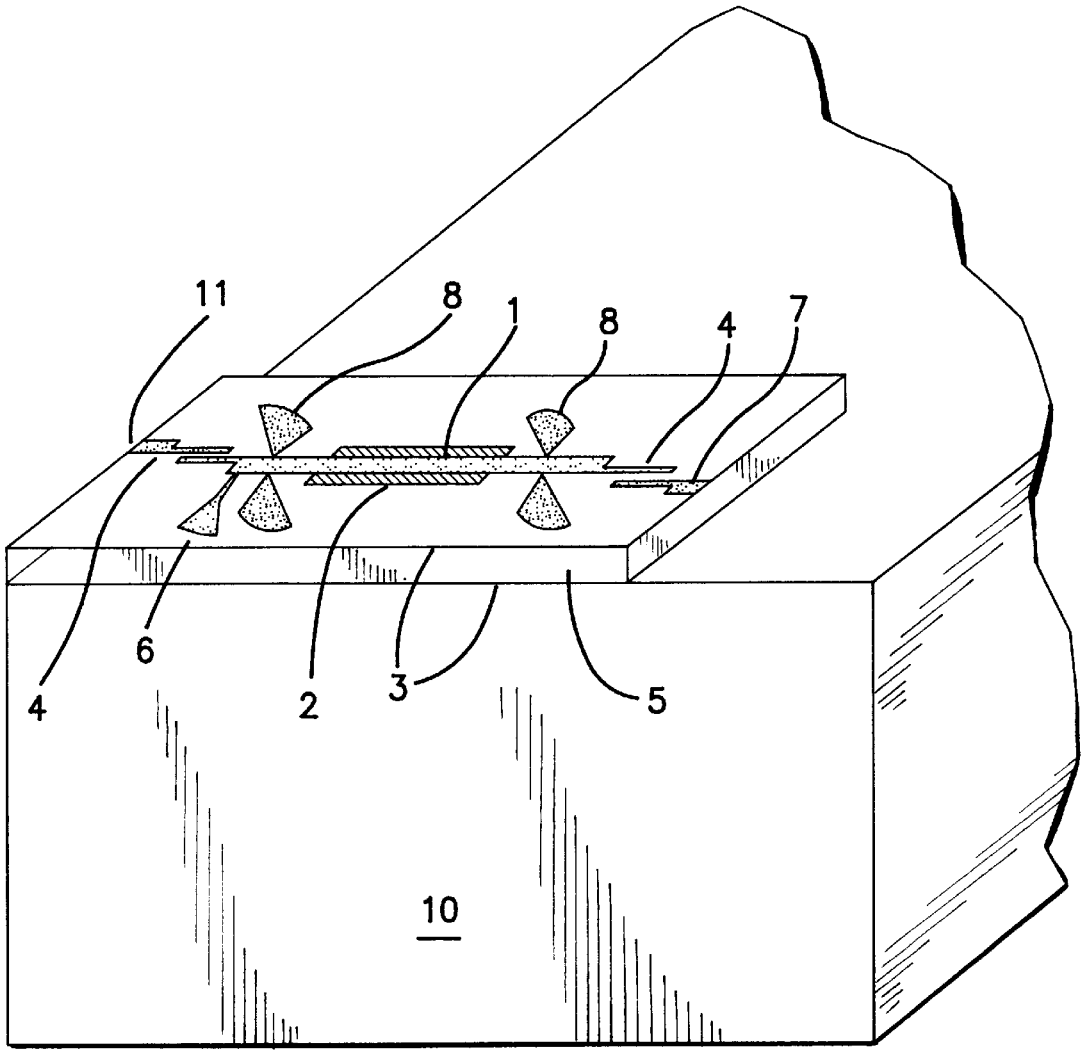
FIG. 17 is a perspective view illustrative of a novel superconducting transmission delay line phase shifter in a thirteenth embodiment according to the present invention.

A thirteenth embodiment according to the present invention will be described in detail with reference to FIGS. 17 and 18. FIG. 17 illustrates a micro-strip superconducting signal transmission line phase shifter which is monolithically integrated on a $LaAlO_3$ monocrystal layer 5. The $LaAlO_3$ monocrystal layer 5 is provided on a supporting substrate 10 which is made of $LaGao_3$. The $LaAlO_3$ monocrystal layer 5 has a thickness of 5 micrometers. The $LaAlO_3$ monocrystal layer 5 shows a low dielectric loss. The $LaAlO_3$ monocrystal layer 5 illustrated has a rectangular shape. The $LaAlO_3$ monocrystal layer 5 comprises three sections. The first section is a signal input section positioned at a side of the signal input. The second section is a phase shifting section positioned at an intermediate of the $LaAlO_3$ monocrystal layer 5. The third section is a signal output section positioned at a side of the signal output. A superconductor ground electrode 3 made of $Y_1Ba_2Cu_3O_x$ is provided on an entire part of the bottom of the $LaAlO_3$ monocrystal layer 5. A $SrTiO_3$ monocrystal ferroelectric 2 is selectively provided in the second section or the phase shifting section of the $LaAlO_3$ monocrystal layer 5. The $SrTiO_3$ monocrystal ferroelectric 2 extends between boundaries of the phase shifting section to the signal input and output sections of the $LaAlO_3$ monocrystal layer 5. The $SrTiO_3$ monocrystal ferroelectric 2 has the same thickness as the $LaAlO_3$ monocrystal layer 5. The bottom of the $SrTiO_3$ monocrystal ferroelectric 2 is positioned at the same level as the bottom of the $LaAlO_3$ monocrystal layer 5 so that the bottom of the $SrTiO_3$ monocrystal ferroelectric 2 is in contact with the top of the superconductor ground electrode 3 made of $Y_1Ba_2Cu_3O_x$. A $Y_1Ba_2Cu_3O_x$ superconducting signal transmission line 1 is provided to extend on the top surface of the $LaAlO_3$ monocrystal layer 5 in a longitudinal direction of the rectangular-shaped $LaAlO_3$ monocrystal layer 5. The $Y_1Ba_2Cu_3O_x$ superconductor signal transmission line 1 comprises a straight line across the signal input section, the $SrTiO_3$ monocrystal ferroelectric 2 the signal input section. The $Y_1Ba_2Cu_3O_x$ superconducting signal transmission line 1 is not completely buried in the $SrTiO_3$ monocrystal ferroelectric 2 and the $LaAlO_3$ monocrystal layer 5. The top of the $Y_1Ba_2Cu_3O_x$ superconducting signal transmission line 1 has the same level as the top of the $SrTiO_3$ monocrystal ferroelectric 2 and the $LaAlO_3$ monocrystal layer 5. The $Y_1Ba_2Cu_3O_x$ superconducting signal transmission line 1 has a width and a distance from the top of the $Y_1Ba_2Cu_3O_x$ superconductor ground electrode 3, wherein the width and the distance are determined so that an impedance of the $Y_1Ba_2Cu_3O_x$ superconducting signal transmission line 1 is set at 50 Ω.

Impedance adjusters 8 are provided in the signal input section and the signal output section of the $LaAlO_3$ monocrystal layer 5. In the signal input section of the $LaAlO_3$ monocrystal layer 5, the impedance adjusters 8 are provided at opposite sides of the $Y_1Ba_2Cu_3O_x$ superconducting signal transmission line 1. Each of the impedance adjusters 8 is coupled to the $Y_1Ba_2Cu_3O_x$ superconducting thin film. Each of the impedance adjusters 8 is fan-shaped and not completely buried in the signal input section of the $LaAlO_3$ monocrystal layer 5. In the signal output section of the $LaAlO_3$ monocrystal layer 5, the impedance adjusters 8 are provided at opposite sides of the $Y_1Ba_2Cu_3O_x$ superconducting signal transmission line 1. Each of the impedance adjusters 8 is coupled to the $Y_1Ba_2Cu_3O_x$ superconducting signal transmission line 1. Each of the impedance adjusters 8 is fan-shaped and not completely buried in the signal output section of the $LaAlO_3$ monocrystal layer 5. The $Y_1Ba_2Cu_3O_x$ superconducting impedance adjuster 8 serves to prevent any reflection of the signal.

An RF filter 6 is provided in the signal output section of the $LaAlO_3$ monocrystal layer 5. The RF filter 6 is coupled to the $Y_1Ba_2Cu_3O_x$ superconducting signal transmission line 1. A bias voltage is applied, by a dc power supply not illustrated, between the RF filter 6 and the $Y_1Ba_2Cu_3O_x$ superconductor ground electrode 3. The RF filter 6 serves as a low pass filter which prevents the high frequency signals from transmitting the dc power supply.

An input terminal 11 is provided in the signal input section of the $LaAlO_3$ monocrystal layer 5. The input terminal 11 is made of $Y_1Ba_2Cu_3O_x$ superconductor.

An output terminal 7 is provided in the signal output section of the $LaAlO_3$ monocrystal layer 5. The output terminal 7 is made of $Y_1Ba_2Cu_3O_x$ superconductor.

In the signal input section of the $LaAlO_3$ monocrystal layer 5, a capacitor 4 is provided between the input terminal 11 and the end of the superconducting signal transmission line 1 in the signal input section of the $LaAlO_3$ monocrystal layer 5. In the signal output section of the $LaAlO_3$ monocrystal layer 5, a capacitor 4 is provided between the output terminal 7 and the end of the superconducting signal transmission line 1 in the signal output section of the $LaAlO_3$ monocrystal layer 5. The capacitor 4 in the signal input section serves to prevent the dc voltage applied on the superconducting signal transmission line 1 from transmitting to the signal input terminal 11. The capacitor 4 in the signal output section serves to prevent the dc voltage applied on the superconducting signal transmission line 1 from transmitting to the signal output terminal 7. The capacitor 4 comprises two part parallel lines arranged in parallel to each other. The capacitor 4 is made of $Y_1Ba_2Cu_3O_x$ superconductor. The input and output terminals 7 are made of $Y_1Ba_2Cu_3O_x$ superconductor.

It was confirmed that the $Y_1Ba_2Cu_3O_x$ superconductor ground electrode 3 shows zero resistance at 89K. It was also confirmed that the $Y_1Ba_2Cu_3O_x$ superconducting signal transmission line 1 shows zero resistance at 85K. FIG. 18 illustrates the variation of the dielectric constant of the $SrTiO_3$ monocrystal ferroelectric 2 versus a bias dc voltage applied between the $Y_1Ba_2Cu_3O_x$ superconductor ground electrode 3 and the $Y_1Ba_2Cu_3O_x$ superconducting signal transmission line 1. The mark "O" represents the variation in the dielectric constant of the $SrTiO_3$ monocrystal ferroelectric 2, when no dc voltage is applied between the $Y_1Ba_2Cu_3O_x$ superconductor ground electrode 3 and the $Y_1Ba_2Cu_3O_x$ superconducting signal transmission line 1. The mark "●" represents the variation in the dielectric constant of the $SrTiO_3$ monocrystal ferroelectric 2, when a dc voltage of 2 V is applied between the $Y_1Ba_2Cu_3O_x$ superconductor ground electrode 3 and the $Y_1Ba_2Cu_3O_x$ superconducting signal transmission line 1. The mark "Δ" represents the variation in the dielectric constant of the $SrTiO_3$ monocrystal ferroelectric 2, when a dc voltage of 4 V is applied between the $Y_1Ba_2Cu_3O_x$ superconductor ground electrode 3 and the $Y_1Ba_2Cu_3O_x$ superconducting signal transmission line 1. The mark "■" represents the variation in the dielectric constant of the $SrTiO_3$ monocrystal ferroelectric 2, when a dc voltage of 6 V is applied between the $Y_1Ba_2Cu_3O_x$ superconductor ground electrode 3 and the $Y_1Ba_2Cu_3O_x$ superconducting signal transmission line 1. The mark "□" represents the variation in the dielectric constant of the $SrTiO_3$ monocrystal ferroelectric 2, when a dc voltage of 8 V is applied between the $Y_1Ba_2Cu_3O_x$ superconductor ground electrode 3 and the $Y_1Ba_2Cu_3O_x$ superconducting signal transmission line 1.

Figure 18:
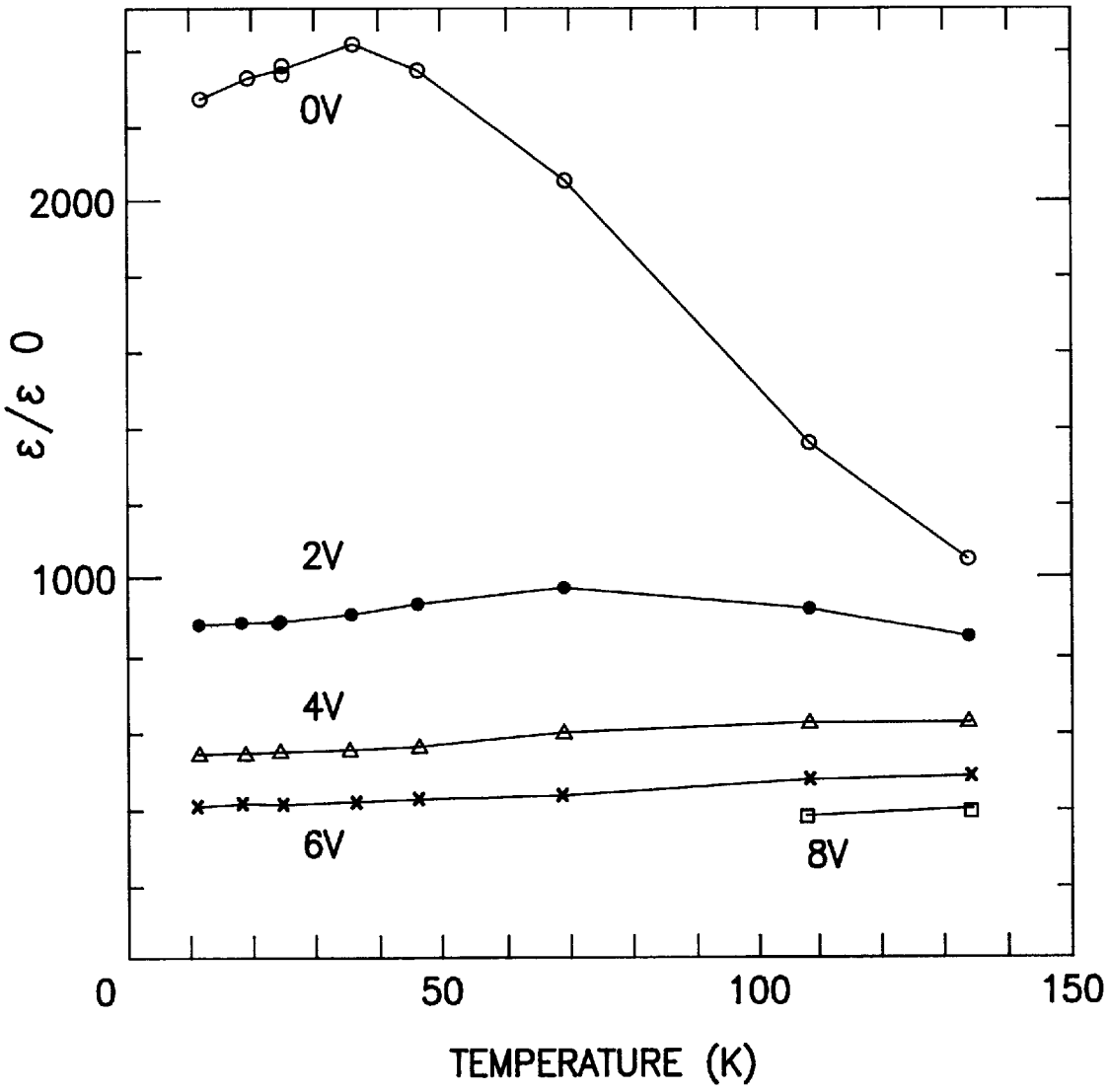
FIG. 18 is a diagram illustrative of the dielectric constant of ferroelectric applied with dc electric fields of various intensities versus the variation of temperature.

From FIG. 18, it can be seen that the variation in the dielectric constant of the $SrTiO_3$ monocrystal ferroelectric 2 due to the variation in the dc bias voltage has a peak in the vicinity of 30K. It may be considered that the $SrTiO_3$ monocrystal ferroelectric 2 show the quantum ferrodielectricity at the low temperature. In the vicinity of 30K, the dielectric constant of the $SrTiO_3$ monocrystal ferroelectric 2 at the bias voltage of 6 V is on sixth of the dielectric constant of the $SrTiO_3$ monocrystal ferroelectric 2 at the bias voltage of OV. The monolithic integration can realize the scaling down of the delay circuit and the reduction of the power dissipation of the delay circuit.

The above superconducting signal transmission line phase shifter was cooled down to a temperature, at which nitrogen is kept in liquid state, to confirm the transparent/reflection performances of the above superconducting signal transmission line phase shifter. In this case, it is required to apply a higher bias voltage than the bias voltage needed in the third embodiment. In a frequency range of 3.5 GHz–4.4 GHz, an insertion loss ($S_{21}$) is about 3 dB and a reflection coefficient ($S_{11}$) is not less than 15 dB. When an electric field of 1.5 V/μm is applied onto the $SrTiO_3$ monocrystal ferroelectric 2, the signals in the frequency range of 3.5 GHz–4.4 GHz show a phase shift of about 60 degrees.

Figure 2:
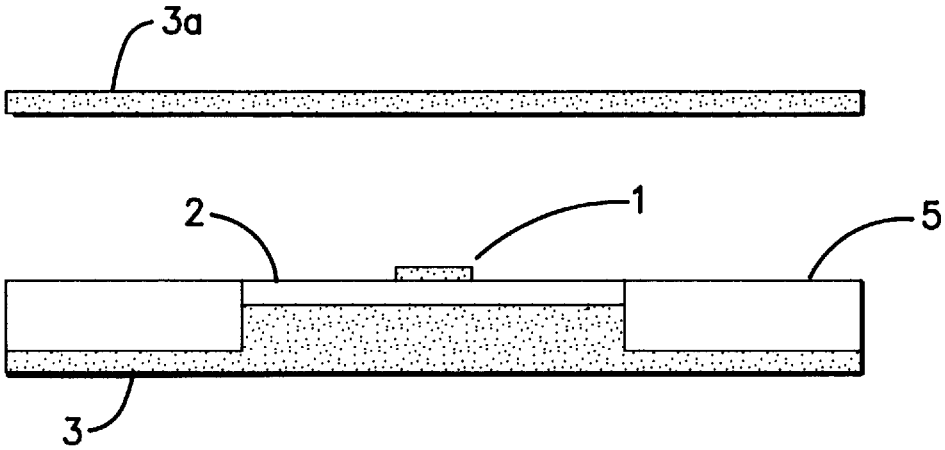
FIG. 2 is a cross sectional elevation view taken along II—II in FIG. 1 illustrative of a novel superconducting transmission delay line phase shifter in a fourteenth embodiment according to the present invention.

A fourteenth embodiment according to the present invention will be described in detail with reference to FIGS. 1 and 2. A ground electrode 3 in FIG. 2 is made of a superconductor. The ground electrode 3 comprises a first section having a large thickness and a second section having a smaller thickness. The first section comprises a slender band having a width. The second section extends along opposite sides of the first section. The bottom of the second section is level to the bottom of the first section. The top of the first section is positioned above the top of the second section. A ferroelectric film 2 is provided on a top surface of the first section of the ground electrode 3. The ferroelectric film 2 has the same width as the width of the first section of the ground electrode. A superconducting signal transmission line 1, on which signals are transmitted, is provided on the ferroelectric film 2. The superconducting signal transmission line 1 has a width smaller than the width of the ferroelectric film 2. A layer 5 is made of a material showing a low dielectric loss. The layer 5 is provided on the second section at opposite sides of the first section of the ground electrode 3. The layer 5 has a thickness which is equal to a total thickness of the first section of the ground electrode and the ferroelectric film 2 so that the top of the layer 5 is level with the top of the ferroelectric film 2. An RF filter 6 in FIG. 1 is provided on the layer 5 and coupled to the superconducting signal transmission line 1. The RF filter 6 comprises a plurality of square-shaped plates made of a superconductor. The square-shaped plates are spaced apart from each other and connected via a superconducting connection line made of the same superconductor as the square-shaped plates. The square-shaped plates have different areas from each other. The square-shaped plates of the RF filter 6 are arranged so that a square-shaped plate having a relatively smaller area is connected near to the superconducting signal transmission line rather than a square-shaped plate having a larger area. A superconducting plate roof 3*a* in FIG. 2 is provided to cover the superconducting transmission delay line phase shifter. The superconducting plate-like roof 3*a* is spaced apart from the superconducting signal transmission line 1. The superconducting plate-like roof 3*a* is coupled to the ground electrode. The superconducting signal transmission line 1 and ground electrode are made of $Y_1Ba_2Cu_3O_x$. The layer is made of $LaAlO_3$. The ferroelectric comprises $SrTiO_3$. An impedance of the superconducting signal transmission line 1 is set at 50 Ω.

The above superconducting signal transmission line phase shifter was cooled down to a temperature, at which nitrogen is kept in liquid state, to confirm the transparent/reflection performances of the above superconducting signal transmission line phase shifter. At a frequency of 12.7 GHz and an electric field of 0.7 V/μm is applied onto the $SrTiO_3$ monocrystal ferroelectric 2, the signals show a phase shift of about 40 degrees.

Whereas modifications of the present invention will be apparent to a person having ordinary skill in the art, to which the invention pertains, it is to be understood that embodiments shown and described by way of illustrations are by no means intended to be considered in a limiting sense. Accordingly, it is to be intended to cover by claims any modifications of the present invention which fall within the spirit and scope of the invention.

What is claimed is:

1. A superconducting transmission delay line phase shifter comprising:

a layer comprised of a low dielectric loss material, said layer comprising first, second and third adjacent sections, said second section being positioned between said first and third sections, each of said sections having a respective width which is equal to a width of said layer, lengths of said sections summing to define a length of said layer;

a ferroelectric insert comprised of a ferroelectric material, said ferroelectric material having a composition which is different from a composition of said low dielectric loss material, said ferroelectric insert being disposed only in said second section, said ferroelectric insert extending along an entire said length of said second section, said ferroelectric insert having a width less than said width of said second section;

a single thin film of a conductor having a high conductivity, said conductive thin film extending across an entirety of lower surfaces of said first, second and third sections; and a superconducting signal transmission line, comprising: a signal input section; a phase shifting section connected to said signal input section, a width of said phase shifting section being less than said width of said ferroelectric insert; and a signal output section connected to said phase shifting section, wherein said signal input section is in contact with said first section, wherein said signal output section is in contact with said third section, and wherein said phase shifting section is in contact with said ferroelectric insert;

wherein said superconducting signal transmission line is comprised of $V_3Si$.

2. The superconducting transmission delay line phase shifter as claimed in claim 1, wherein said signal input section is disposed in said first section such that an upper surface of said signal input section is aligned with an upper surface of said first section, wherein said signal output section is disposed in said third section such that an upper surface of said signal output section is aligned with an upper surface of said third section, wherein said phase shifting section is disposed in said ferroelectric material such that an upper surface of said phase shifting section is aligned with an upper surface of said ferroelectric material, and wherein the top of said ferroelectric material is aligned with an upper surface of said layer.

3. The superconducting transmission delay line phase shifter as claimed in claim 1, wherein said signal input section is disposed upon said first section such that an upper surface of said signal input section is positioned above an upper surface of said first section, wherein said signal output section is disposed upon said third section such that an upper surface of said signal output section is positioned above an upper surface of said third section, wherein said phase shifting section is disposed upon said ferroelectric material such that an upper surface of said phase shifting section is positioned above an upper surface of said ferroelectric material, and wherein the upper surface of said ferroelectric material is aligned with an upper surface of said layer.

4. The superconducting transmission delay line phase shifter as claimed in claim 1, wherein said signal input section is disposed entirely below an upper surface of said first section, wherein said signal output section is disposed entirely below an upper surface of said third section, wherein said phase shifting section is disposed entirely below an upper surface of said ferroelectric material, and wherein an upper surface of said ferroelectric material is aligned with an upper surface of said layer.

5. The superconducting transmission delay line phase shifter as claimed in claim 1, wherein said signal input section, said phase shifting section and said signal output section are aligned with one another.

6. The superconducting transmission delay line phase shifter as claimed in claim 1, wherein a lower surface of said ferroelectric material is aligned with the lower surfaces of said first, second and third sections so that said lower surface of said ferroelectric material is in contact with said thin film.

7. The superconducting transmission delay line phase shifter as claimed in claim 1, wherein a lower surface of said ferroelectric material is positioned above the lower surfaces of said first, second and third sections so that said lower surface of said ferroelectric material is separated by a portion of said layer from said thin film.

8. The superconducting transmission delay line phase shifter as claimed in claim 1, wherein said superconducting signal transmission line has a width and distance from said thin film determined such that a resulting impedance of said superconducting signal transmission line is about 50 Ω.

9. The superconducting transmission delay line phase shifter as claimed in claim 1, wherein said superconducting signal transmission line is shaped as a straight line.

10. The superconducting transmission delay line phase shifter as claimed in claim 1, further comprising an RF low pass filter provided on said first section of said layer, and said RF low pass filter being electrically coupled to said signal input section of said superconducting signal transmission line.

11. The superconducting transmission delay line phase shifter as claimed in claim 10, wherein said RF low pass filter comprises at least a sheet type superconductor, wherein said sheet type superconductor is adapted to be biased with respect to said thin film.

12. The superconducting transmission delay line phase shifter as claimed in claim 11, wherein said sheet type superconductor of said RF low pass filter is fan-shaped.

13. The superconducting transmission delay line phase shifter as claimed in claim 10, further comprising an impedance adjuster provided on said first section of said layer, said impedance adjuster being electrically coupled to said signal input section of said superconducting signal transmission line, and said impedance adjuster being provided closer to said second section than is said RF filter.

14. The superconducting transmission delay line phase shifter as claimed in claim 13, wherein said impedance adjuster comprises a pair of sheet type superconductors which are positioned at opposite sides of said signal input section of said superconducting signal transmission line.

15. The superconducting transmission delay line phase shifter as claimed in claim 14, wherein each of said sheet type superconductors of said impedance adjuster is fan-shaped.

16. The superconducting transmission delay line phase shifter as claimed in claim 1, further comprising:

at least one high pass filter provided on said first section of said layer, said high pass filter being joined with an outer end of said signal input section of said superconducting signal transmission line; and a signal input terminal provided on said first section of said layer, said signal input terminal being electrically coupled via said high pass filter to said signal input section of said superconducting signal transmission line.

17. The superconducting transmission delay line phase shifter as claimed in claim 16, wherein said high pass filter comprises a capacitor.

18. The superconducting transmission delay line phase shifter as claimed in claim 17, wherein said capacitor comprises a pair of line parts comprised of a same material as said superconducting signal transmission line, said line parts being spaced apart from each other, said line parts extending in parallel to each other and along a same direction of said superconducting signal transmission line, one of said line parts being joined with said outer end of said input signal section and another of said line parts being joined with said signal input terminal.

19. The superconducting transmission delay line phase shifter as claimed in claim 16, wherein said signal input terminal comprises a single line part comprised of a same material as said superconducting signal transmission line and said single line part is arranged along a same direction of said superconducting signal transmission line.

20. The superconducting transmission delay line phase shifter as claimed in claim 1, further comprising an impedance adjuster provided on said third section of said layer and said impedance adjuster being electrically coupled to said signal output section of said superconducting signal transmission line.

21. The superconducting transmission delay line phase shifter as claimed in claim 20, wherein said impedance adjuster comprises a pair of sheet type superconductors which are positioned at opposite sides of said signal output section of said superconducting signal transmission line.

22. The superconducting transmission delay line phase shifter as claimed in claim 21, wherein each of said sheet type superconductors of said impedance adjuster is fan-shaped.

23. The superconducting transmission delay line phase shifter as claimed in claim 1, further comprising:

at least one high pass filter provided on said third section of said layer, said high pass filter being joined with an outer end of said signal output section of said superconducting signal transmission line; and a signal output terminal provided on said third section of said layer, said signal output terminal being electrically coupled via said high pass filter to said signal output section of said superconducting signal transmission line.

24. The superconducting transmission delay line phase shifter as claimed in claim 23, wherein said high pass filter comprises a capacitor.

25. The superconducting transmission delay line phase shifter as claimed in claim 24, wherein said capacitor comprises a pair of line parts comprised of a same material as said superconducting signal transmission line, said line parts being spaced apart from each other, and said line parts extending in parallel to each other and along a same direction of said superconducting signal transmission line, one of said line parts being joined with said outer end of said signal input section and another of said line parts being joined with said signal input terminal.

26. The superconducting transmission delay line phase shifter as claimed in claim 23, wherein said signal output terminal comprises a single line part comprised of a same material as said superconducting signal transmission line and said single line part is arranged along a same direction of said superconducting signal transmission line.

27. The superconducting transmission delay line phase shifter as claimed in claim 1, wherein said thin film is comprised of a superconductor selected from the group consisting of $Hg_2Ba_2Ca_1Cu_2O_x$, $Hg_2Ba_2Ca_2Cu_3O_x$, $Hg_1Ba_2Cl_1Cu_2O_x$ and $Hg_1Ba_2Cl_2Cu_3O_x$.

28. The superconducting transmission delay line phase shifter as claimed in claim 1, wherein said thin film is comprised of $La_1Sr_2Cu_3O_x$.

29. The superconducting transmission delay line phase shifter as claimed in claim 1, wherein said thin film is comprised of $V_3Si$.

30. The superconducting transmission delay line phase shifter as claimed in claim 1, wherein said thin film is comprised of a superconductor selected from the group consisting of Nb, Pb, La-β, La-α, Al, Cd, Nb—Zr and Nb—Ti.

31. The superconducting transmission delay line phase shifter as claimed in claim 1, wherein said layer is comprised of $NdAlO_3$.

32. The superconducting transmnission delay line phase shifter as claimed in claim 1, wherein said ferroelectric comprises a material selected from the group consisting of $SrTiO_3$, $CaTiO_3$ and $NaTiO_3$.

33. The superconducting transmission delay line phase shifter as claimed in claim 1, further comprising a supporting substrate on which said superconducting transmission delay line phase shifter is provided.

34. The superconducting transmission delay line phase shifter as claimed in claim 1, wherein said thin film is comprised of a superconductor selected from the group consisting of $Nd_1Ba_2Cu_3O_x$, $Eu_1Ba_2Cu_3O_x$, $Gd_1Ba_2Cu_3O_x$, $Dy_1Ba_2Cu_3O_x$, $Ho_1Ba_2Cu_3O_x$, $Er_1Ba_2Cu_3O_x$ and $Yb_1Ba_2Cu_3O_x$.

35. The superconducting transmission delay line phase shifter as claimed in claim 1, wherein said thin film is comprised of a superconductor selected from the group consisting of $Bi_2Sr_2Ca_1Cu_2O_x$ and $Bi_2Sr_2Ca_2Cu_3O_x$.

36. The superconducting transmission delay line phase shifter as claimed in claim 1, wherein said thin film is comprised of a superconductor selected from the group consisting of $Tl_2Ba_2Ca_1Cu_2O_x$ and $Tl_2Ba_2Ca_2Cu_3O_x$.

37. The superconducting transmission delay line phase shifter as claimed in claim 1, wherein said supporting substrate is comprised of $LaGaO_3$.

38. A superconducting transmission delay line phase shifter comprising:

a layer comprised of a low dielectric loss material, said layer comprising first, second and third adjacent sections, said second section being positioned between said first and third sections, each of said sections having a respective width which is equal to a width of said layer, lengths of said sections summing to define a length of said layer;

a single ground electrode comprising a conductor having a high conductivity, said ground electrode extending across an entirety of a lower surface of said layer;

a ferroelectric insert comprised of a ferroelectric material, said ferroelectric material having a composition which is different from a composition of said low dielectric loss material, said ferroelectric insert being disposed only in said second section, said ferroelectric insert extending along an entire said length of said second section, said ferroelectric insert having a width less than said width of said second section, a lower surface of said ferroelectric insert being aligned with the lower surface of said layer so that said lower surface of said ferroelectric insert is in contact with said ground electrode;

a superconducting signal transmission line, comprising: a signal input section; a phase shifting section connected to said signal input section, a width of said phase shifting section being less than said width of said ferroelectric insert; and a signal output section connected to said phase shifting section, an RF low pass filter provided on said first section of said layer, said RF low pass filter being electrically coupled to said signal input section of said superconducting signal transmission line;

an impedance adjuster provided on said first section of said layer, said impedance adjuster being electrically coupled to said signal input section of said superconducting signal transmission line, said impedance adjuster being provided closer to said second section than is said RF filter;

at least one high pass filter provided on said first section of said layer, said high pass filter being joined with an outer end of said signal input section of said superconducting signal transmission line; and a signal input terminal provided on said first section of said layer, said signal input terminal being electrically coupled via said high pass filter to said signal input section of said superconducting signal transmission line, wherein said signal input section is in contact with said first section, wherein said signal output section is in contact with said third section, and wherein said phase shifting section is in contact with said ferroelectric insert;

wherein said superconducting signal transmission line is comprised of $V_3Si$.

39. The superconducting transmission delay line phase shifter as claimed in claim 38, wherein said ground electrode is comprised of a superconductor selected from the group consisting of Nb, Pb, La-β, La-α, Nb—Zr and Nb—Ti.

40. The superconducting transmission delay line phase shifter as claimed in claim 38, wherein said layer is comprised of $NdAlO_3$.

41. The superconducting transmission delay line phase shifter as claimed in claim 38, wherein said ferroelectric comprises a material selected from the group consisting of $SrTiO_3$, $CaTiO_3$ and $NaTiO_3$.

42. The superconducting transmission delay line phase shifter as claimed in claim 38, further comprising a supporting substrate on which said superconducting transmission delay line phase shifter is provided.

43. The superconducting transmission delay line phase shifter as claimed in claim 38, wherein said supporting substrate is comprised of $LaGaO_3$.

44. The superconducting transmission delay line phase shifter as claimed in claim 38, wherein said ground electrode is comprised of a superconductor selected from the group consisting of $Bi_2Sr_2Ca_1Cu_2O_x$ and $Bi_2Sr_2Ca_2Cu_3O_x$.

45. The superconducting transmission delay line phase shifter as claimed in claim 38, wherein said ground electrode is comprised of a superconductor selected from the group consisting of $Tl_2Ba_2Ca_1Cu_2O_x$ and $Tl_2Ba_2Ca_2Cu_3O_x$.

46. The superconducting transmission delay line phase shifter as claimed in claim 38, wherein said signal input section is disposed in said first section such that an upper surface of said signal input section is aligned with an upper surface of said first section, wherein said signal output section is disposed in said third section such that an upper surface of said signal output section is aligned with an upper surface of said third section, wherein said phase shifting section is disposed in said ferroelectric material, such that an upper surface of said phase shifting section is aligned with an upper surface of said ferroelectric material, and wherein the top of said ferroelectric material is aligned with an upper surface of said layer.

47. The superconducting transmission delay line phase shifter as claimed in claim 38, wherein said signal input section is disposed upon said first section such that an upper surface of said signal input section is positioned above an upper surface of said first section, wherein said signal output section is disposed upon said third section such that an upper surface of said signal output section is positioned above an upper surface of said third section, wherein said phase shifting section is disposed upon said ferroelectric material such that an upper surface of said phase shifting section is positioned above an upper surface of said ferroelectric material, and wherein an upper surface of said ferroelectric material is aligned with an upper surface of said layer.

48. The superconducting transmission delay line phase shifter as claimed in claim 38, wherein said signal input section is disposed entirely below an upper surface of said first section, wherein said signal output section is disposed entirely below an upper surface of said third section, wherein said phase shifting section is disposed entirely below an upper surface of said ferroelectric material, and wherein an upper surface of said ferroelectric material is aligned with an upper surface of said layer.

49. The superconducting transmission delay line phase shifter as claimed in claim 38, wherein said signal input section, said phase shifting section and said signal output section are aligned with one another.

50. The superconducting transmission delay line phase shifter as claimed in claim 38, wherein said superconducting signal transmission line has a width and a distance from said ground electrode determined such that a resulting impedance of said superconducting signal transmission line is about 50 Ω.

51. The superconducting transmission delay line phase shifter as claimed in claim 38, wherein said superconducting signal transmission line is shaped as a straight line.

52. The superconducting transmission delay line phase shifter as claimed in claim 38, wherein said RF low pass filter comprises at least a sheet type superconductor, wherein said sheet type superconductor is adapted to be biased with respect to said ground electrode.

53. The superconducting transmission delay line phase shifter as claimed in claim 52, wherein said sheet type superconductor of said RF low pass filter is fan-shaped.

54. The superconducting transmission delay line phase shifter as claimed in claim 53, wherein said impedance adjuster comprises a pair of sheet type superconductors which are positioned at opposite sides of said signal input section of said superconducting signal transmission line.

55. The superconducting transmission delay line phase shifter as claimed in claim 54, wherein each of said sheet type superconductors of said impedance adjuster is fan-shaped.

56. The superconducting transmission delay line phase shifter as claimed in claim 38, wherein said high pass filter comprises a capacitor.

57. The superconducting transmission delay line phase shifter as claimed in claim 56, wherein said capacitor comprises a pair of line parts comprised of a same material as said superconducting signal transmission line, said line parts are spaced apart from each other, said line parts extend in parallel to each other and along a same direction of said superconducting signal transmission line, one of said line parts being electrically connected to said outer end of said input signal section and another of said line parts being connected to said signal input terminal.

58. The superconducting transmission delay line phase shifter as claimed in claim 57, wherein said signal input terminal comprises a single line part comprised of a same material as said superconducting signal transmission line and said single line part is arranged alone a same direction of said superconducting signal transmission line.

59. The superconducting transmission delay line phase shifter as claimed in claim 38, further comprising an impedance adjuster provided on said third section of said layer and said impedance adjuster being electrically coupled to said signal output section of said superconducting signal transmission line.

60. The superconducting transmission delay line phase shifter as claimed in claim 59, wherein said impedance adjuster comprises a pair of sheet type superconductors which are positioned at opposite sides of said signal output section of said superconducting signal transmission line.